US008528133B2

(12) United States Patent
Van Houte

(10) Patent No.: US 8,528,133 B2
(45) Date of Patent: Sep. 10, 2013

(54) BEDMAKING SYSTEM, BED AND METHOD FOR MAKING A BED

(75) Inventor: Izaak Van Houte, Amersfoort (NL)

(73) Assignee: OSIB IP Holdings Ltd, Nicosia (CY)

( * ) Notice: Subject to any disclaimer, the term of this patent is extended or adjusted under 35 U.S.C. 154(b) by 541 days.

(21) Appl. No.: 12/600,074

(22) PCT Filed: May 23, 2007

(86) PCT No.: PCT/NL2007/050241

§ 371 (c)(1), (2), (4) Date: Nov. 20, 2009

(87) PCT Pub. No.: WO2008/143495

PCT Pub. Date: Nov. 27, 2008

(65) Prior Publication Data

US 2010/0115699 A1 May 13, 2010

(51) Int. Cl.

| | |
|---|---|
| ***A47C 21/02*** | (2006.01) |
| ***A47C 21/00*** | (2006.01) |
| ***A47G 9/00*** | (2006.01) |
| ***A47G 9/02*** | (2006.01) |

(52) U.S. Cl.
USPC ..... 5/488; 5/482; 5/485; 5/494; 5/503.1; 5/504.1

(58) Field of Classification Search
USPC ..... 5/482, 485, 488, 494, 503.1, 504.1, 5/248
See application file for complete search history.

(56) References Cited

U.S. PATENT DOCUMENTS

| | | | | |
|---|---|---|---|---|
| 2,721,338 | A * | 10/1955 | Resnick | 5/285 |
| 2,947,008 | A | 8/1960 | Wild | |
| 3,388,406 | A * | 6/1968 | Scrivener | 5/488 |
| 3,581,321 | A | 6/1971 | Geary | |
| 3,596,297 | A * | 8/1971 | James | 5/2.1 |
| 3,784,993 | A * | 1/1974 | Berkowitz | 5/308 |
| 3,855,655 | A * | 12/1974 | Propst | 5/488 |
| 3,895,404 | A * | 7/1975 | Wilson | 5/482 |
| 3,916,460 | A * | 11/1975 | Harty | 5/13 |
| 4,024,591 | A * | 5/1977 | Raczkowski | 5/488 |
| 4,027,343 | A * | 6/1977 | Hooker | 5/200.1 |
| 4,441,222 | A | 4/1984 | Tascarella | |
| 5,926,874 | A * | 7/1999 | Browder | 5/488 |
| 5,933,885 | A * | 8/1999 | Glassford | 5/424 |
| 2004/0221393 | A1 * | 11/2004 | Stokes | 5/692 |

FOREIGN PATENT DOCUMENTS

| | | |
|---|---|---|
| CH | 502088 A | 1/1971 |

OTHER PUBLICATIONS

International Search Report. International application No. PCT/NL2007/050241. Date of the actual completion of the International search: Jan. 11, 2008.

* cited by examiner

*Primary Examiner* — William Kelleher
*Assistant Examiner* — Eric Kurilla
(74) *Attorney, Agent, or Firm* — Mollborn Patents, Inc.; Fredrik Mollborn

(57) ABSTRACT

A bedmaking system for a bed with a base mattress has a flexible topping mattress; two fastening feet; an U-shaped brace defined by two parallel arms and a bar connecting the arms. The arms are each pivotly mounted to a fastening foot for pivoting around a common axis between a normal position and an assisting position. The bar extends along the first length edge of the topping mattress and is mounted to said first length edge. The second length edge of the topping mattress extends along the second length side of the base mattress.

14 Claims, 4 Drawing Sheets

BEDMAKING SYSTEM, BED AND METHOD FOR MAKING A BED

FIELD OF THE INVENTION

The present invention relates to the field of beds, especially the field of bedmaking.

BACKGROUND OF THE INVENTION

Bedmaking is labour intensive. Used sheets are stripped away and replaced by new sheets or reused to make the bed. The new or used sheet is tucked under the mattress to smooth out wrinkles and unevenness. The sheets are put into position by lifting the mattress and pushing the sheet under the mattress to hold it in position. Sometimes access to do the job properly is limited by a headboard or footboard. Further lifting of the mattress of a double bed is difficult. Taking into account that for making a double bed one needs access to the bed from at least two opposing sides, preferably all sides, a double bed cannot be placed in a narrow space.

The object of the present invention is to provide a bedmaking system, which allows making the bed from only one side, also in case the bed is a double bed.

SUMMARY OF THE INVENTION

According to the invention, this object is achieved by providing a bedmaking system for a bed provided with a base mattress, wherein the bed making system comprises:

a flexible topping mattress for covering the base mattress;

two fastening feet for fastening the bed making system to the bed;

an essentially U-shaped brace defined by two parallel arms and a bar connecting one of the ends of the arms; the other ends of the arms each being mounted to a said fastening foot at a pivoting connection to be swingable around a common pivoting axis between a normal position and an assisting position; the normal position and assisting position lying, viewed in the width direction of the base mattress, at opposing sides of the pivoting axis;

wherein the length and width of the topping mattress essentially correspond to the length and width, respectively, of the base mattress;

wherein the interspace between the arms is larger than the length of the base mattress;

wherein the bar of the brace extends along the first length edge of the topping mattress and is mounted to said first length edge;

wherein the second length edge of the topping mattress extends along the second length side of the base mattress;

wherein, in the normal position, the bar of the brace extends along the first length side of the base mattress and the topping mattress lies flat on the base mattress; and wherein, in the assisting position, the bar of the brace extends over the top face of the base mattress and the topping mattress is, partly, folded double.

In this application. the terms length (in length, length edge, length side, etc.) and width (in width, width edge, width side, width walls, etc.) are used to indicate the direction of extension of the respective member with respect to the bed, which is assumed to have an essentially rectangular shape defined by two mutually perpendicular directions. It gives the relative mutual relation, it does not imply that length is longer or shorter than width. Further, in this application, the terms first and second in relation to the words 'side' and 'edge' are only used to differentiate between one edge/side and the other edge/side. In the claims it was assumed that the second edge/side, is the one where the person making the bed stands, and that the first length edge/side, is the one which is not accessible for the person making the bed.

In the assisting position, a sheet can be brought into engagement with the topping mattress. This can be achieved by simply hooking, such as by loosely folding, a longitudinal edge part of the sheet around the first length edge of the topping mattress. Applicant learnt from practical experiments that loosely folding without attachment of the sheet to the topping mattress (or brace) suffices, but in case one prefers it is according to the invention also possible to fix the sheet to the first longitudinal edge of the topping mattress (or brace) by means of for example Velcron® or press fasteners. Hooking can also be done by means of an envelope formed along a longitudinal edge part of the sheet. This envelope engages around the first length edge of the topping mattress and/or brace. Additional advantage of fixation of the sheet to the topping mattress or use of an envelope, is that the brace can be brought from the normal position to the assisting position by just pulling the sheet. Once the sheet is hooked around the first length edge of the topping mattress or fixed to the topping mattress or brace, the brace is swung back to the normal position. This draws the sheet to extend over the base mattress whilst the opposing second longitudinal edge part of the sheet remains where it is. Subsequently, one can smooth the sheet by tightening it along the second longitudinal edge part. In all this the topping mattress functions to guide the sheet. Further, the topping mattress positions the brace by its weight in both the normal position and the assisting position.

Topping mattresses according to the invention are as such known and commonly used on top of so called box spring mattresses but also on top of other types of mattresses, such as foam mattresses, to increase the comfort or to provide a top mattress layer which can easily be changed or shaken out. In general a topping mattress will have a thickness of between about 1 to 7 cm, such as 4-6 cm.

According to a further embodiment, the arms of the brace each have a first segment abutting the pivoting connection, said first segment extending horizontally in the normal position and being connected with the bar through one or more further segments; and wherein, in the normal position and viewed in vertical direction, the bar lies higher than the first segments. This first segment provides in the normal position a rest for the brace, which limits the movement of the brace, whilst simultaneously the bar carrying the first longitudinal edge of the topping mattress and the hooked edge part of the sheet is supported at a higher vertical level preventing the bar to shift downward along the first length side of the base mattress.

According to another further embodiment, the vertical distance from the bar to the pivoting axis corresponds, in the normal position, with about the length of the vertical projection of the base mattress above the pivoting axis such that in the normal position the bar lies level with or just below the top face of the base mattress. This ensures on the one hand that the bar does not lie higher than the base mattress (which would be inconvenient) and on the other hand that the topping mattress and sheet are not drawn downwards along the first length side of the base mattress.

In order to keep the base mattress in position with respect to the bedmaking system, it is advantageous when the fastening feet are formed by sectional parts extending perpendicular to the pivoting axis, and when each of the sectional parts is provided with a stop for the first side of the base mattress.

In order to be able to remove the topping mattress, for example to exchange it for a new one, it is advantageous when the mounting of the first length edge of the topping mattress to the bar is a detachable mounting. In order to be able to use a removed topping mattress again, for example after turning it or after cleaning it, it is further advantageous when the detachable mounting is a mounting which is remountable after detachment.

Operation of the bedmaking system according to the invention can take place in several ways. It can be done manually. For example, a bedmaking person supports him/herself, if necessary, with one hand on the bed, grasps with the other hand an arm of the brace, and swings the brace from the normal position to the assisting position. Also use of a rod provided with an engagement member can be considered in order to bring the brace from its normal to its assisting position. In case the sheet is fixed to the topping mattress or brace or in case the topping mattress engages in an envelope formed along a longitudinal side of the sheet, it suffices to pull the sheet at the second length side of the base mattress. Swinging the brace back from its assisting position into its normal position can be done just by pushing it so that gravity allows it to fall back in the normal position. But, when swinging back, one can also guide the brace gently with the rod or the hand. In order to automate the operation of the brace, it is according to the invention advantageous when the bedmaking system further comprises a drive for swinging the brace as well as a control for operating the drive.

According to a second aspect, the present invention relates to a bed comprising:

a bedmaking system according to the invention;

a base mattress; and a bed frame supporting the base mattress.

According to a further embodiment of the second aspect of the invention, the bed comprises two width walls, each extending next to and spaced from a width side of the base mattress to form a gap between the respective width wall and respective width side of the base mattress; wherein the bed further comprises elongated filling pads for filling both the gaps. According to the invention those width walls can be formed by boards attached to the frame of the bed, can formed by the walls of the room where the bed is placed, can be formed by adjacent furniture, etc as longs as these width walls provide between the mattress and the width wall some gap which can be filled by filling pads. After placing the sheet on top of the topping mattress, swinging the brace into the normal position, and tightening the sheet along the second length edge of the topping mattress, the sheet can be tightened along the width edges of the topping mattress by inserting the filling pads into the gaps.

According to a third aspect, the present invention relates to a method for making a bed according to the invention, comprising subsequently the following steps:

a) swinging the brace from the normal position to the assisting position;

b) extending and laying a sheet along the second length edge of the topping mattress;

c) hook a first longitudinal edge part of the sheet on the first length edge of the topping mattress;

d) swinging the brace from the assisting position to the normal position to extend the sheet in the width direction over the base mattress.

According to a further embodiment of the third aspect, one removes preceding step b) a used sheet, and one uses in step b) a clean sheet.

According to another further embodiment of the third aspect, preceding step b) one:

removes the topping mattress from the bed;

shakes out and/or turns around the topping mattress; and remounts the topping mattress to the bar.

According to still another further embodiment of the third aspect, preceding step b) one:

removes the topping mattress from the bed;

exchanges the topping mattress for another topping mattress; and mounts the other topping mattress to the bar.

SHORT DESCRIPTION OF THE DRAWINGS

Next below the invention will be described further with reference to the enclosed drawing. In this drawing.

DESCRIPTION OF AN EMBODIMENT

Figure 1:
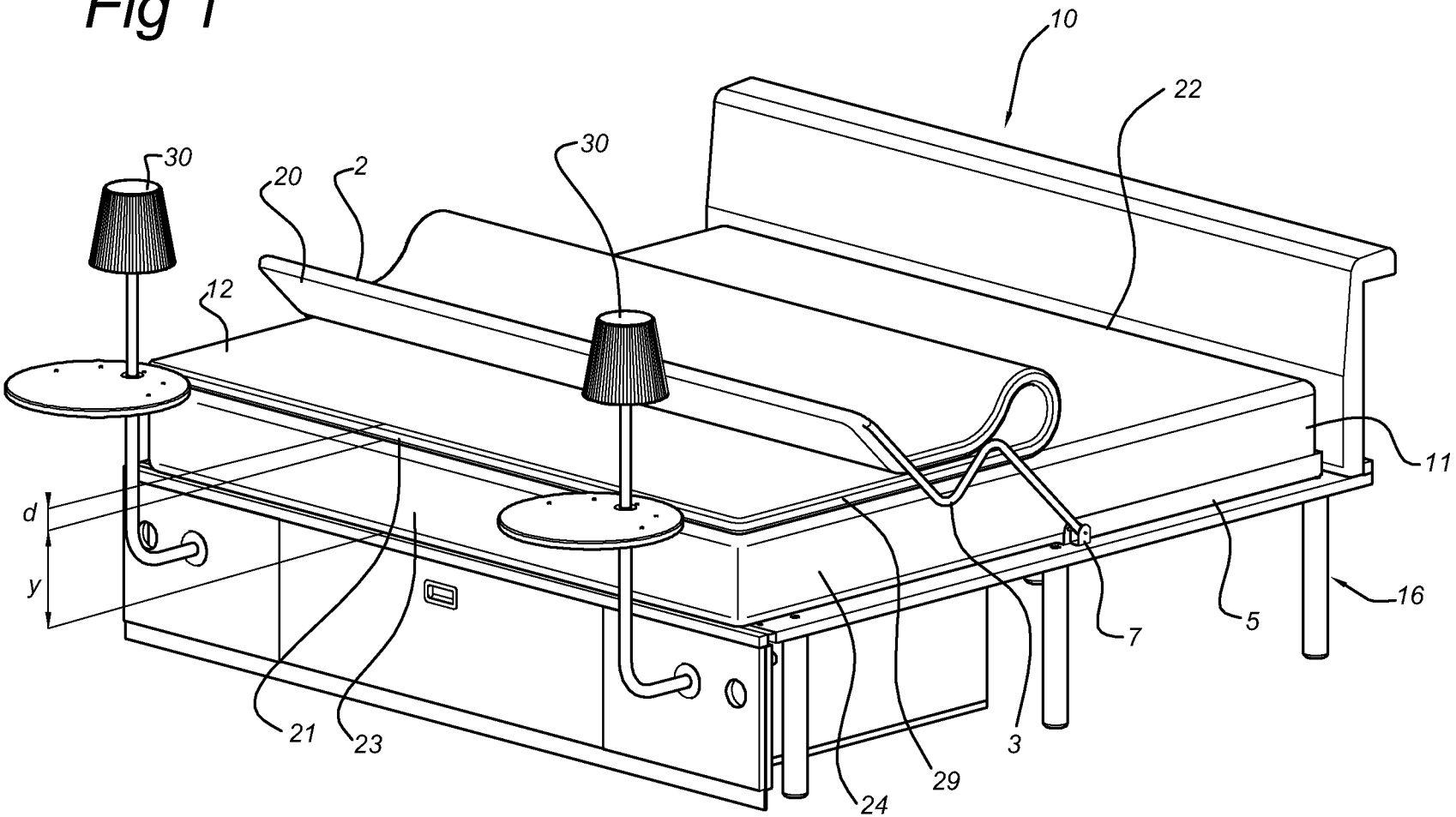
FIG. 1 shows a perspective view of bed according to the invention with the bedmaking system in its assisting position.
Figure 2:
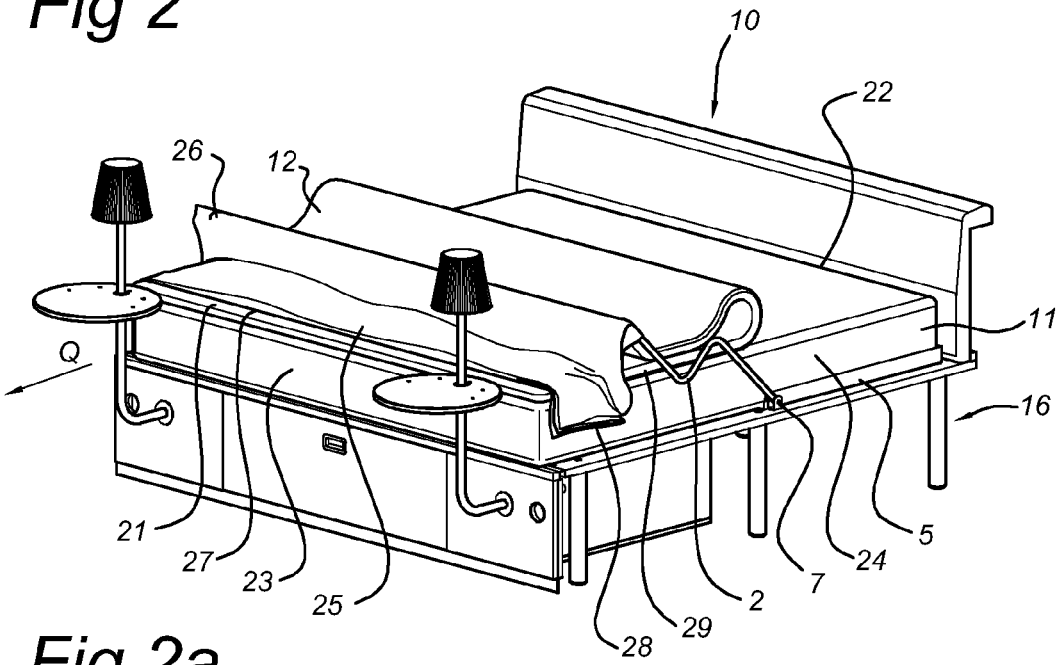
FIG. 2 shows a perspective view of bed according to the invention with the bedmaking system in its assisting position with a sheet arranged on the bed.
Figure 4:
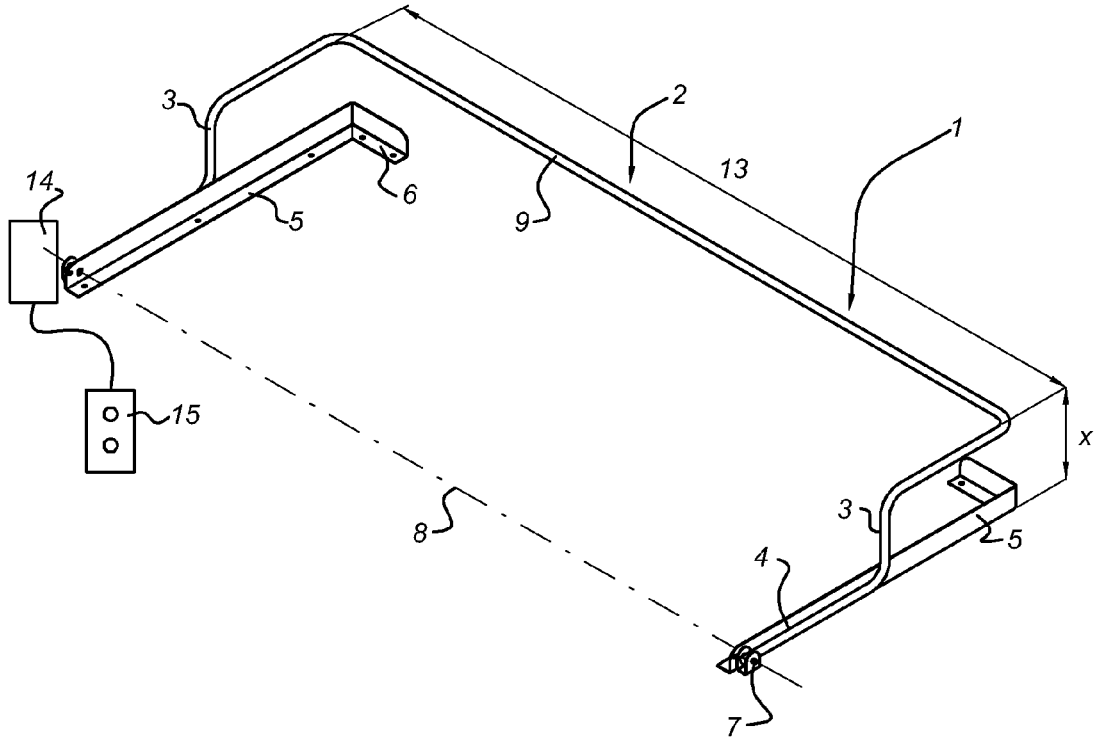
FIG. 4 shows a perspective view of the bedmaking system applied in FIGS. 1-3

FIG. 4 shows a bedmaking system 1 according to the invention. The bed making system 1 comprises an essentially U-shaped brace 2 formed by a bar 9 and two arms 3. The free end of each arm 3 is mounted on a fastening foot 5 at a pivoting connection 7. The pivoting connection allows swinging of the brace 2 with respect to the fastening feet 5 around pivoting axis 8. FIG. 4 shows the brace 2 in the so called normal position. From this position the brace 2 can swing to the so called assisting position as shown in FIGS. 1 and 2. Optionally, a drive 14 and control 15 can be provided to operate the swinging of the brace 2.

Referring to FIG. 4, the arms 3 each have a first segment 4, which, in the normal position, extends horizontally. This first segment 4 provides support to keep the bar 9 at a vertical height X higher than the pivoting axis 8. Further, the supporting feet 5 are in the form of elongate sectional members 5, each having an L-shaped cross section. At their ends facing away from the pivoting connection 7, the elongate sectional members 5 are each provided with a stop 6. Each stop 6 is elongate and L-shaped in cross section. Optionally, the stops 6 can be connected to form one large, single stop.

As shown in FIGS. 1 and 2, the bedmaking system 1 is mounted on the frame 16 of a bed 10. This frame 16 supports a base mattress 11, in this example a box spring mattress.

The base mattress 11 is essentially rectangular with a thickness Y. The base mattress has a width extending in the direction of double arrow W and a length extending in the direction of double arrow L. The base mattress has a first length side 22, a second length side 23 parallel to the first length side 22, and two parallel width sides 24.

On top of the base mattress 11 there is provided a topping mattress 12, which is flexible so that it can be folded double easily. The topping mattress 12 has a thickness d of about 1-7 cm, preferably about 4-6 cm. The topping mattress 12 has a first length edge 20, a second length edge 21 parallel to the first length edge 20, and two parallel width edges 29.

In the direction L, the length of the base mattress 11 and topping mattress are about the same, for example about 2 m, and are both smaller than the interspace 13 (FIG. 4) between the arms 3 of the brace. In the width direction W, the length—also called width to differentiate—of the base mattress 11 and topping mattress 12 are about the same, for example about 1.0 m to about 2.0 m.

As said above, in the normal position, the bar 9 is kept at a vertical height X above the pivoting axis 8. This vertical height X will be smaller than or at most equal to vertical distance Y that the base mattress 11 projects above the bed frame 16. In case the base mattress lies on top of the bed frame, this vertical projecting distance Y will be equal to the thickness of the base mattress. However in case the base mattress lies (partly) submerged in the bed frame 16, this vertical projecting distance Y will be smaller than the thickness of the base mattress.

Figure 5:
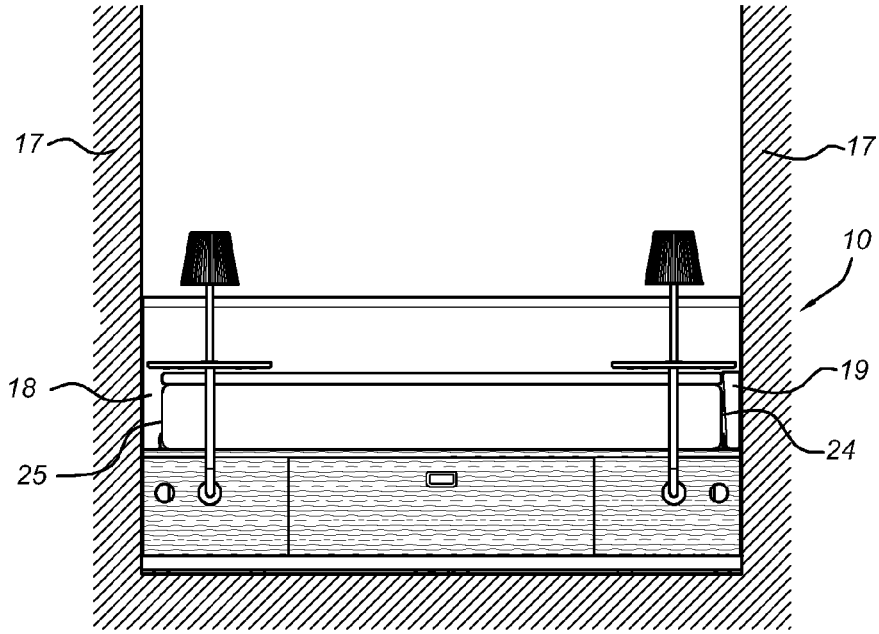
FIG. 5 shows, partly in cross section, a front view of the bed of FIGS. 1 and 2, which bed is placed between two walls of a chamber.
Figure 6:
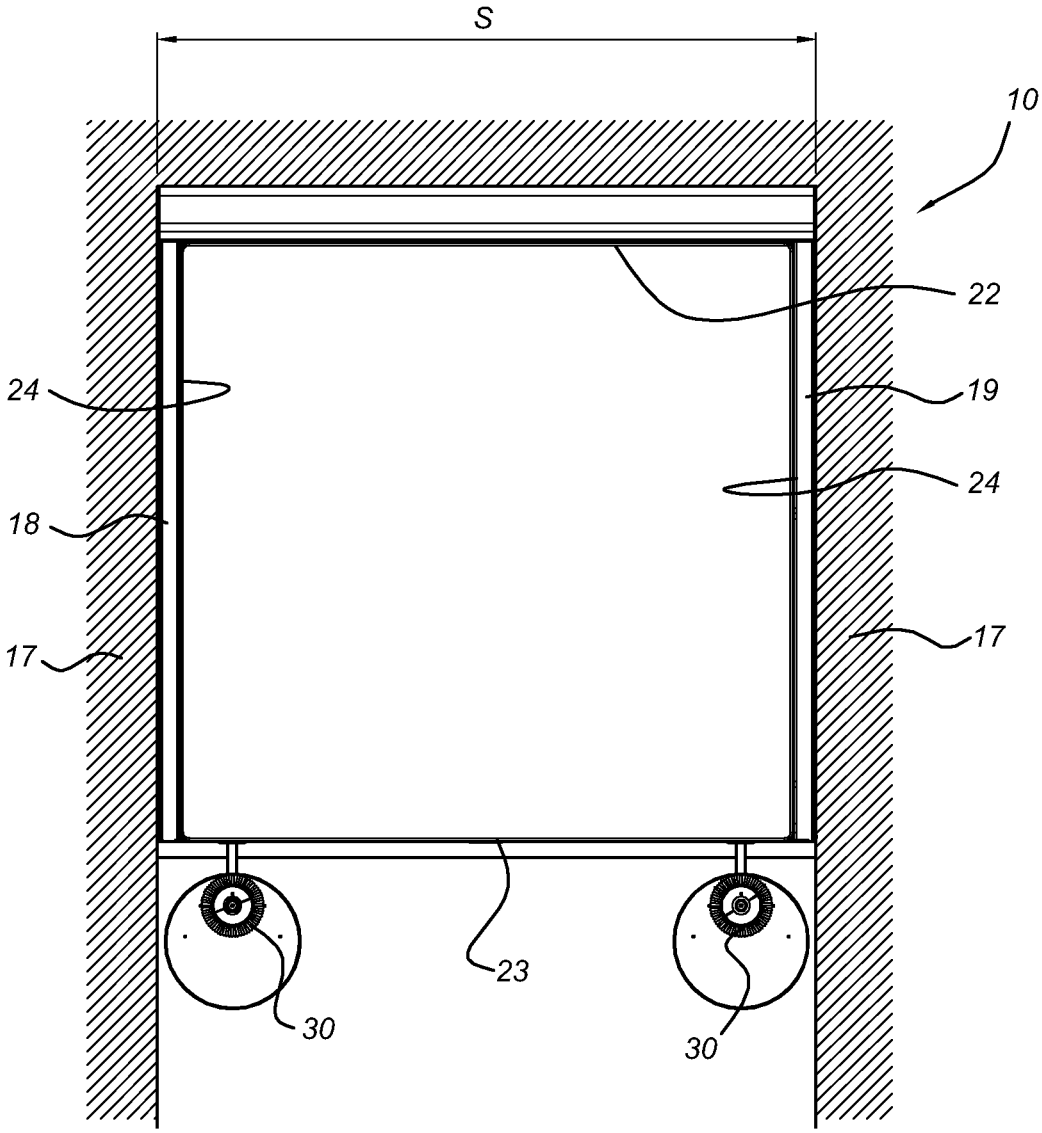
FIG. 6 shows, partly in cross section, a plan view of the bed according to FIG. 3.

Referring to FIGS. 5 and 6, it is shown that, with a bedmaking system 1 according to the invention, the bed 10 can be placed in narrow spaces, such as between chamber walls 17 defining a space S which is only 10 cm wider than the length L of the mattress. As will become clearer below, the bedmaking system 1 enables a person to make the bed from a position in front of the bed somewhere between the lamps 30.

Figure 2A:
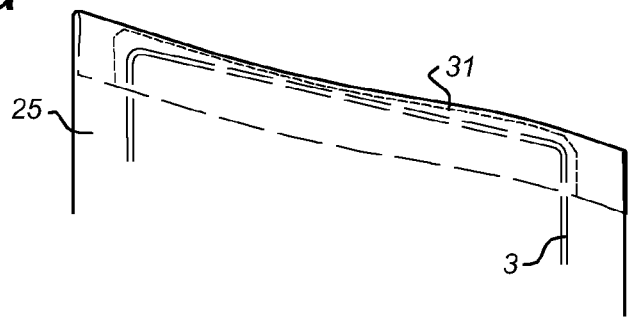
FIG. 2A shows in perspective view as a detail the engagement of the sheet with the topping mattress.
Figure 3:
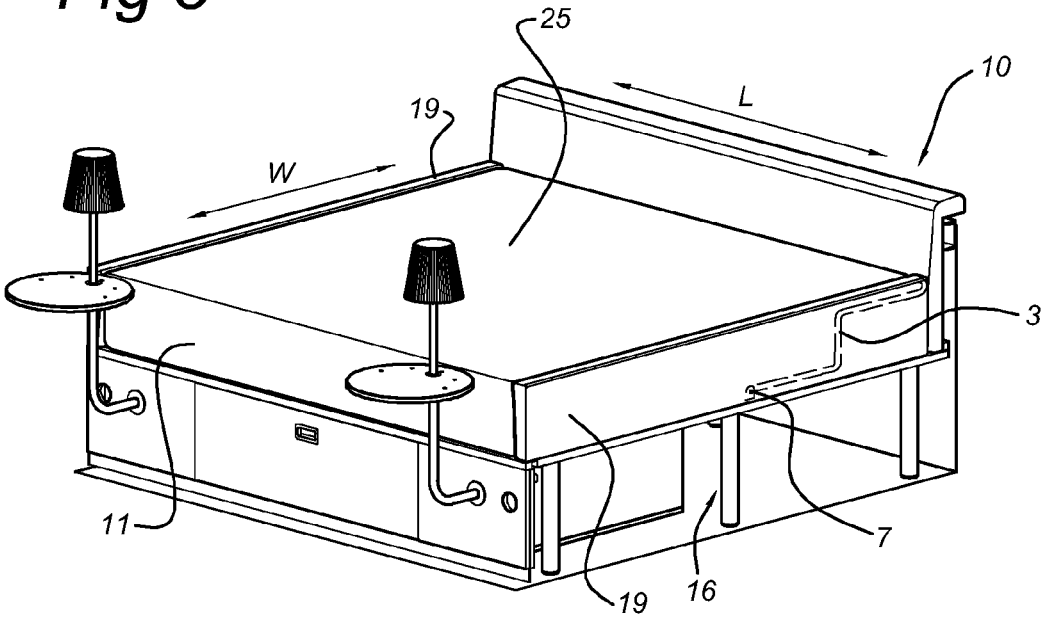
FIG. 3 shows a perspective view similar to the one in FIGS. 1 and 2, however with the bedmaking system in its normal position.

As shown in FIG. 2A, the sheet 25 is advantageously provided with an envelope 31 of say 10-25 cm depth. In the assisting position, this allows insertion of the second longitudinal edge 20 of the topping mattress 12 into the envelope 31 so that the sheet and topping mattress engage along said second longitudinal edge 20. This provides advantages when one swings the brace from the normal position to the assisting position and when, with the brace in the normal position, the sheet is stretched to flatten out wrinkles The operation of the bedmaking system is as follows:

One swings the brace 2 from the normal position (shown in FIG. 4 and with dashed lines in FIG. 3) to the assisting position (which position could also be called the bedmaking position) as shown in FIG. 1; this can be done by hand, with the help of a rod, by means of a drive 14 and control 15, etc. A bedmaking person can do all this from a position in between the lamps 30. So doing, the topping mattress is folded double and the first length edge 21 of the topping mattress is brought close to the bedmaking person. In case a sheet 25—to be removed—is provided, this sheet 25 is preferably provided with an envelope 31 (or fixed to the topping mattress at the brace), which allows swinging of the brace to the assisting position just by pulling the sheet 25 in the direction of arrow Q (see FIG. 2). On the end of the swing, the weight of the topping mattress will be able to keep the brace in the assisting position. In this respect it is advantageous when the topping mattress has a thickness of about 4-6 cm as this implies in practice sufficient weight.

Referring to FIG. 2 and with the brace 2 in the assisting position, one places a sheet 25 on that part of the topping mattress 12 which extends along the position where the person stands and still lies flat on the base mattress. Conveniently, this sheet 25 is folded in a zigzag pattern so that a second longitudinal edge part 27 can be oriented along the second length edge 21 of the topping mattress, whilst the other first longitudinal edge part 26 of the sheet 25 can easily be placed to lie over the first length edge 20 of the topping mattress 12 and bar 9. The first longitudinal edge part 26 of the sheet 25 can just be hooked around the first length edge 20/bar 9 by loosely folding it around as shown in FIG. 2. Or in case an envelope is provided, this first length edge 20 is inserted into the envelope 31. Note that having the sheet 25 folded in zigzag pattern is not necessary, as one can also just unfold the sheet and hook the first longitudinal edge part 26 of the sheet 25 around the first length edge 20/bar 9 whilst the rest of the sheet lies on the ground before the bed in the region of the lamps 30.

Subsequently, with the sheet 25 in lying in zigzag pattern or unfolded on the ground, one swings the brace 2 back from the assisting position to the normal position. Gravity, supported by the weight of the topping mattress, ensures that the brace returns to its normal position. Doing this, the topping mattress is folded open again, the brace 2 draws the sheet 25 over the topping mattress 12 and lays the sheet 25 flat over the topping mattress. Subsequently, a bedmaking person will stretch the sheet 25 by pulling at the second longitudinal edge part 27 smoothly in the draw direction of arrow Q (see FIG. 2 for arrow Q). This smoothes out wrinkles and unevenness in the width direction W. In case the sheet is provided with an envelope 31, this envelope will prevent the sheet from being pulled from the bed. Next the second longitudinal edge part 27 of the sheet can be folded under the part of the base mattress adjoining the second longitudinal edge part 23 of this base mattress.

Subsequently one can smoothen out wrinkles and unevenness of the sheet in the length direction L. One can do this by pushing the width edge parts 28 of the sheet 25 down along the width sides 24 of the base mattress. One can use a rod for this. But one can also use filling pads 19 (see FIGS. 5 and 6 on the right side and FIG. 3) which can be inserted into the gaps 18 (see FIGS. 5 and 6 on the left side) between each width side 24 of the base mattress and an adjacent object, such as a chamber wall 17.

LIST OF REFERENCES USED IN THE DRAWING

| | |
|---|---|
| 1 = | bedmaking system |
| 2 = | brace |
| 3 = | arm of brace |
| 4 = | first segment of arm |
| 5 = | sectional part/fastening foot |
| 6 = | stop |
| 7 = | pivoting connection |
| 8 = | pivoting axis |
| 9 = | bar |
| 10 = | bed |
| 11 = | base mattress |
| 12 = | topping mattress |
| 13 = | interspace between arms |
| 14 = | drive |
| 15 = | control |
| 16 = | bed frame |
| 17 = | width wall |
| 18 = | gap |
| 19 = | filling pad |
| 20 = | first length edge of topping mattress |
| 21 = | second length edge of topping mattress |
| 22 = | first length side of base mattress |
| 23 = | second length side of base mattress |
| 24 = | width side of base mattress |
| 25 = | sheet |
| 26 = | first longitudinal edge part of sheet |
| 27 = | second longitudinal edge part of sheet |
| 28 = | width edge part of sheet |

-continued

| LIST OF REFERENCES USED IN THE DRAWING | |
|---|---|
| 29 = | width edge of topping mattress |
| 30 = | lamp |
| 31 = | envelope |
| d = | thickness of topping mattress |
| L = | length direction |
| Q = | arrow indicating draw direction |
| W = | width direction |
| X = | vertical distance between brace and pivoting axis, in the normal position. |
| Y = | thickness of base mattress |

The invention claimed is:

1. Bedmaking system for a bed provided with a base mattress, the bedmaking system comprising;

a flexible topping mattress for covering the base mattress;

two fastening feet for fastening the bedmaking system to the bed; and an essentially U-shaped brace defined by two parallel arm and a bar connecting one of the ends of the arms; the other ends of the arms each being mounted to a fastening foot at a pivoting connection to be swingable around a common pivoting axis between a normal position and an assisting position; the normal position and assisting position lying, viewed in the width direction of the base mattress, at opposing sides of the pivoting axis; wherein the length and width of the topping mattress essentially correspond to the length and width, respectively, of the base mattress; wherein an interspace between the arms is larger than the length of the base mattress; wherein the bar of the brace extends along a first length edge of the topping mattress and is inserted through an opening located along the first length edge of the topping mattress; wherein a second length edge of the topping mattress extends along the second length side of the base mattress; wherein, in the normal position, the bar of the brace extends along a first side of the base mattress and the topping mattress lies fiat on the base mattress; and wherein, in the assisting position, the bar of the brace extends over the top face of the base mattress and the topping mattress is folded in half.

2. Bedmaking system according to claim 1, wherein the arms of the brace each have a first segment abutting the pivoting connection, the first segment extending horizontally in the normal position and being connected with the bar through one or more further segments; and wherein, in the normal position and viewed in vertical direction, the bar lies higher than the first segments.

3. Bedmaking system according to claim 1, wherein, in the normal position, the vertical distance from the bar to the pivoting axis corresponds with about the vertical distance which the base mattress extends above the pivoting axis.

4. Bedmaking system according to claim 1, wherein the topping mattress has a thickness of between about 1 cm to about 7 cm.

5. Bedmaking system according to claim 1, wherein the fastening feet are formed by sectional parts extending perpendicular to the pivoting axis, and wherein each of the sectional parts is provided with a stop for the first side of the base mattress.

6. Bedmaking system according to claim 1, wherein a mounting of the first length edge of the topping mattress to the bar is a detachable mounting.

7. Bedmaking system according to claim 6, wherein the detachable mounting is a mounting which is remountable after detachment.

8. Bedmaking system according to claim 1, further comprising a drive for swinging the brace and a control for operating the drive.

9. Bed comprising:

a bedmaking system according to claim 1;

a base mattress; and a bed frame supporting the base mattress.

10. Bed according to claim 9, wherein the bed comprises two width walls, each extending next to and being spaced from a width side of the base mattress to form a gap between the respective width wall and respective width side of the base mattress;

wherein the bed further comprises elongated filling pads for filling both gaps.

11. Method for making a bed according to claim 9, comprising:

a) swinging the brace from the normal position to the assisting position;

b) extending and laying a sheet along the second length edge of the topping mattress;

c) hooking a first longitudinal edge part of the sheet on the first length edge of the topping mattress;

d) swinging the brace from the assisting position to the normal position to extend the sheet in the width direction over the base mattress.

12. Method according to claim 11, wherein preceding step b) a used sheet is removed, and wherein in step b) a clean sheet is used.

13. Method according to claim 11, wherein preceding step b):

the topping mattress is removed from the bed;

the topping mattress is shaken out and/or turned around; and the bar is reinserted through the opening located along the first length edge of the topping mattress.

14. Method according to claim 11 wherein preceding step b):

the topping mattress is removed from the bed;

the topping mattress is exchanged for another topping mattress; and the bar is reinserted through an opening along a first length edge of the another topping mattress.

* * * * *